US005297634A

United States Patent [19]

Loughlin

[11] Patent Number: 5,297,634

[45] Date of Patent: Mar. 29, 1994

[54] METHOD AND APPARATUS FOR REDUCING WELLBORE-FLUID PRESSURE DIFFERENTIAL FORCES ON A SETTABLE WELLBORE TOOL IN A FLOWING WELL

[75] Inventor: Michael J. Loughlin, Houston, Tex.

[73] Assignee: Baker Hughes Incorporated, Houston, Tex.

[21] Appl. No.: 41,123

[22] Filed: Mar. 30, 1993

Related U.S. Application Data

[63] Continuation of Ser. No. 745,910, Aug. 16, 1991, abandoned.

[51] Int. Cl.[5] ..... E21B 23/06; E21B 33/127; E21B 34/10

[52] U.S. Cl. ..... 166/387; 166/183; 166/184; 166/187; 166/319

[58] Field of Search ..... 166/319, 324, 187, 374, 166/317, 386, 387, 183, 188, 192, 129, 106, 385, 323, 184

[56] References Cited

U.S. PATENT DOCUMENTS

| | | | |
|---|---|---|---|
| 1,925,015 | 8/1933 | Wells | 166/183 |
| 3,422,673 | 1/1969 | Lebourg | 166/187 |
| 3,460,618 | 8/1969 | Blagg | 166/387 |
| 3,460,625 | 8/1969 | Hart et al. | 166/187 X |
| 4,188,998 | 2/1980 | Upton | 166/183 X |
| 4,535,843 | 8/1985 | Jageler | 166/65.1 X |
| 4,749,037 | 6/1988 | Christensen | 166/319 X |
| 4,796,707 | 1/1989 | Halbardier | 166/187 X |
| 4,923,007 | 5/1990 | Sanford et al. | 166/187 |
| 4,953,617 | 9/1990 | Ross et al. | 166/187 |
| 5,040,600 | 8/1991 | Bailey et al. | 166/386 X |

*Primary Examiner*—Hoang C. Dang
*Attorney, Agent, or Firm*—Felsman, Bradley, Gunter & Dillon

[57] ABSTRACT

An apparatus is provided for use in a wellbore for reducing the effects of pressure differential forces which act on settable wellbore tools suspended therein. The apparatus operates to provide a bypass fluid flow path through the settable wellbore tool for directing wellbore fluid through the settable wellbore tool in response to pressure differentials developed across the settable wellbore tool during outward radial expansion of the tool. The apparatus further includes mechanisms for maintaining the bypass fluid flow path in an open condition during at least an expansion mode of operation to diminish the effects of pressure differential developed across the settable wellbore tool. The apparatus also includes mechanisms for closing the bypass fluid flow path once a setting mode of operation is obtained.

21 Claims, 13 Drawing Sheets

METHOD AND APPARATUS FOR REDUCING WELLBORE-FLUID PRESSURE DIFFERENTIAL FORCES ON A SETTABLE WELLBORE TOOL IN A FLOWING WELL

RELATED APPLICATIONS

This patent application is a continuation of U.S. patent application Ser. No. 07/745,910, which was filed on Aug. 16, 1991, entitled "Method and Apparatus for Reducing Wellbore-Fluid Pressure Differential Forces on a Settable Wellbore Tool in a Flowing Well," abandoned, and invented by Michael James Loughlin of Houston, Tex., from which the present application claims the priority of the filing date under 35 U.S.C. § 120.

BACKGROUND OF THE INVENTION

1. Field of the Invention

This invention relates in general to settable wellbore tools, and in particular to settable wellbore tools which are carried into wellbores on either coiled-tubing strings or wirelines and subjected to pressure differentials during setting.

2. Description of the Prior Art

Recent advances in the technology relating to the work-over of producing oil and gas wells have greatly enhanced the efficiency and economy of work-over operations. Through the use of either a coiled-tubing string, or a wireline assembly, work-over operations can now be performed through the production tubing string of a flowing oil and gas well. Two extremely significant advantages have been obtained by the through-tubing technology advances. First, the production tubing string does not need to be removed from the oil and gas well in order to perform work-over operations. This is a significant economic advantage, since work-over rigs are expensive, and the process of pulling a production tubing string is complicated and time consuming. The second advantage is that work-over operations can be performed without "killing" the well. As is known by those in the industry, the "killing" of a producing oil and gas well is a risky operation, and can frequently cause irreparable damage the worked-over well. Until the recent advances in the through-tubing work-over technology, work-over operations usually required that the well be killed.

While the through-tubing work-over technologies have significant advantages, some operating problems have been encountered. One problem, which is addressed by the present invention, is that pressure differentials created within the wellbore by the flowing wellbore fluids can cause unintended displacement of settable wellbore tools, such as bridge plugs and packers. Flow in either direction can exist in a wellbore if a producing zone is in hydraulic communication through the wellbore with a consuming zone. Such interzonal "cross-flow" may exist in a well irrespective of whether it is flowing to the surface.

Settable wellbore tools are operable in a plurality of operating modes including running modes of operation, expansion modes of operation, and setting modes of operation. The settable wellbore tool is maintained in a running condition during a running mode of operation, with a reduced radial dimension so that the settable wellbore tool may be passed downward into the oil and gas well through the production tubing. Once the settable wellbore tool is passed beyond the lower end of the production tubing string, and placed in a desired location, force is applied to the settable wellbore tool to urge it into an expansion mode of operation in which the wellbore tool is urged radially outward from a reduced radial dimension to an intermediate radial dimension, which at least in-part obstructs the flow of wellbore fluid within the wellbore in the region of the settable wellbore tool.

The obstruction created by the settable wellbore tool frequently creates a pressure differential across the settable wellbore tool. Most commonly, this occurs when a packer or bridge plug is set above a producing zone. Wellbore fluids, such as oil and water, will continue flowing into the well due to the pressure differential between the wellbore fluids in the earth's formation and the wellbore itself, as well as the pressure differential between different zones. Consequently, the wellbore fluids tend to flow within the well. However, the settable wellbore tool at least in-part obstructs the flow of wellbore fluids, and, consequently, a pressure differential is created across the wellbore tool.

The cross flow of fluids may urge the settable wellbore tool upward within the wellbore, away from the desired setting location. This unintended, and harmful displacement of the settable wellbore tool can occur because the new through-tubing, work-over technologies do not provide suspension means which are as "stiff" as those found in the more conventional work-over technologies. For example, a wireline-suspended, through-tubing work-over tool offers little resistance to pressure differentials which operate to lift the settable wellbore tool in position within the wellbore. Coiled tubing suspension means also do not provide sufficient "stiffness" to upward movement of the settable wellbore tool.

Additionally, if a pressure differential is developed across the settable wellbore tool with a higher pressure level above the settable wellbore tool, the pressure differential may act to disconnect the settable wellbore tool from the suspension means. In a wireline suspended, through-tubing wellbore tool a sufficiently large pressure differential could snap the wellbore tool loose from the wireline cable. Alternately, a high pressure differential could serve to accidentally actuate pressure-sensitive, or tension sensitive, disconnect devices which are used in both wireline-suspended tools and coiled-tubing suspended tools.

SUMMARY OF THE INVENTION

It is one objective of the present invention to provide an apparatus for use in wellbores which reduces the pressure differential forces caused by wellbore fluid flowing into the wellbore, which act on settable wellbore tools which are suspended in the wellbore on suspension members.

It is another objective of the present invention to provide an apparatus for use in a wellbore which reduces the pressure differential forces acting on a suspended, settable wellbore tool, which includes a bypass fluid flow path extending through the settable wellbore tool for directing wellbore fluid through the settable wellbore tool in response to the pressure differential developed across the settable wellbore tool when it partially obstructs the wellbore and fluid flow exists.

It is yet another objective of the present invention to provide an apparatus for use in a wellbore for reducing the pressure differential forces caused by wellbore fluids flowing into the wellbore, which act on settable wellbore tools suspended in the wellbore, wherein the apparatus includes a bypass fluid flow path extending thorough the settable tool for directing wellbore fluid through the settable wellbore tool in response to the pressure differential developed across it, a means for maintaining the bypass fluid flow path in an open condition during at least an expansion mode of operation to diminish the pressure differential developed across the wellbore tool, and a means for closing the bypass fluid flow path once the setting mode of operation is obtained to prevent the flow of fluid through the settable wellbore tool.

These objectives are achieved as is now described. An apparatus is provided for use in a wellbore for reducing the effects of pressure differential forces. The apparatus includes a settable wellbore tool which is suspended in the wellbore on a suspension member, such as a coil-tubing string or a wireline assembly. The settable wellbore tool is operable in a plurality of operating modes including a running mode of operation, an expansion mode of operation, and a setting mode of operation. During a running mode of operation, the settable wellbore tool is maintained in a reduced radial dimension for passage through wellbore tubular conduits such as production tubing. In an expansion mode of operation, the settable wellbore tool is urged radially outward from the reduced radial dimension to an intermediate radial dimension, and at least in-part obstructs the flow of wellbore fluid within the wellbore in the region of the settable wellbore tool, and creates a pressure differential across the settable wellbore tool. In a setting mode of operation, the settable wellbore tool is further radially expanded into a setting radial dimension, and is urged into a fixed position within the wellbore, in gripping engagement with the wellbore surface.

In the present invention, a bypass fluid flow path is provided, which extends through the settable wellbore tool, and operates to direct wellbore fluid through the settable wellbore tool in response to the pressure differential developed across the settable wellbore tool during at least the expansion mode of operation. The present invention further provides for a means for maintaining the bypass fluid flow path in an open condition, during at least the expansion mode of operation to diminish the pressure differential developed across the settable wellbore tool. Finally, the present invention provides a means for closing the bypass fluid flow path once the setting mode of operation is obtained to prevent the passage of fluid therethrough.

Additional objects, features and advantages will be apparent in the written description which follows.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE INVENTION

Figure 1:
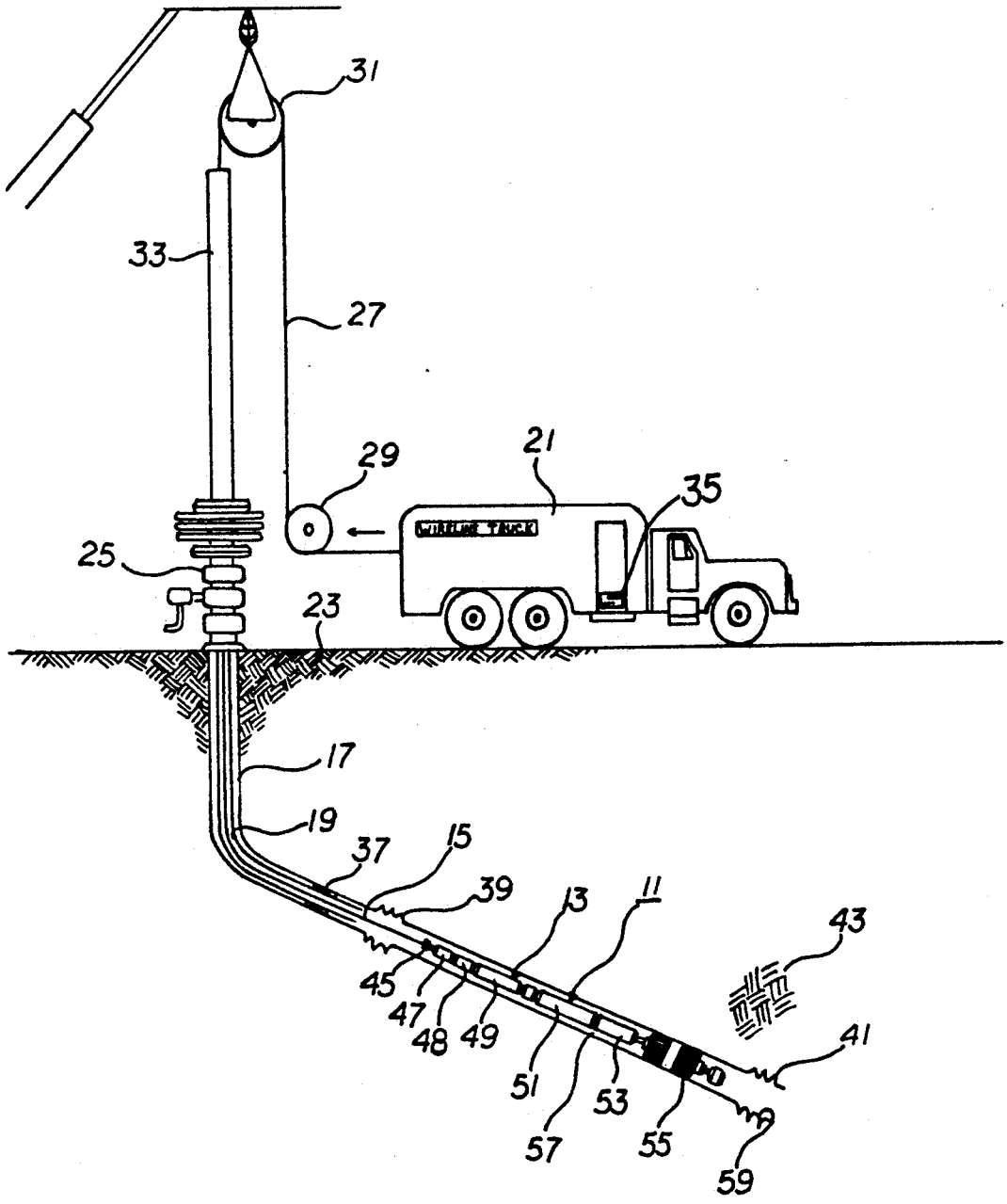
FIGURE 1 PRIOR ART
FIG. 1 is a schematic view of a prior art inflatable wellbore tool suspended within a wellbore on a wireline assembly.
Figure 2:
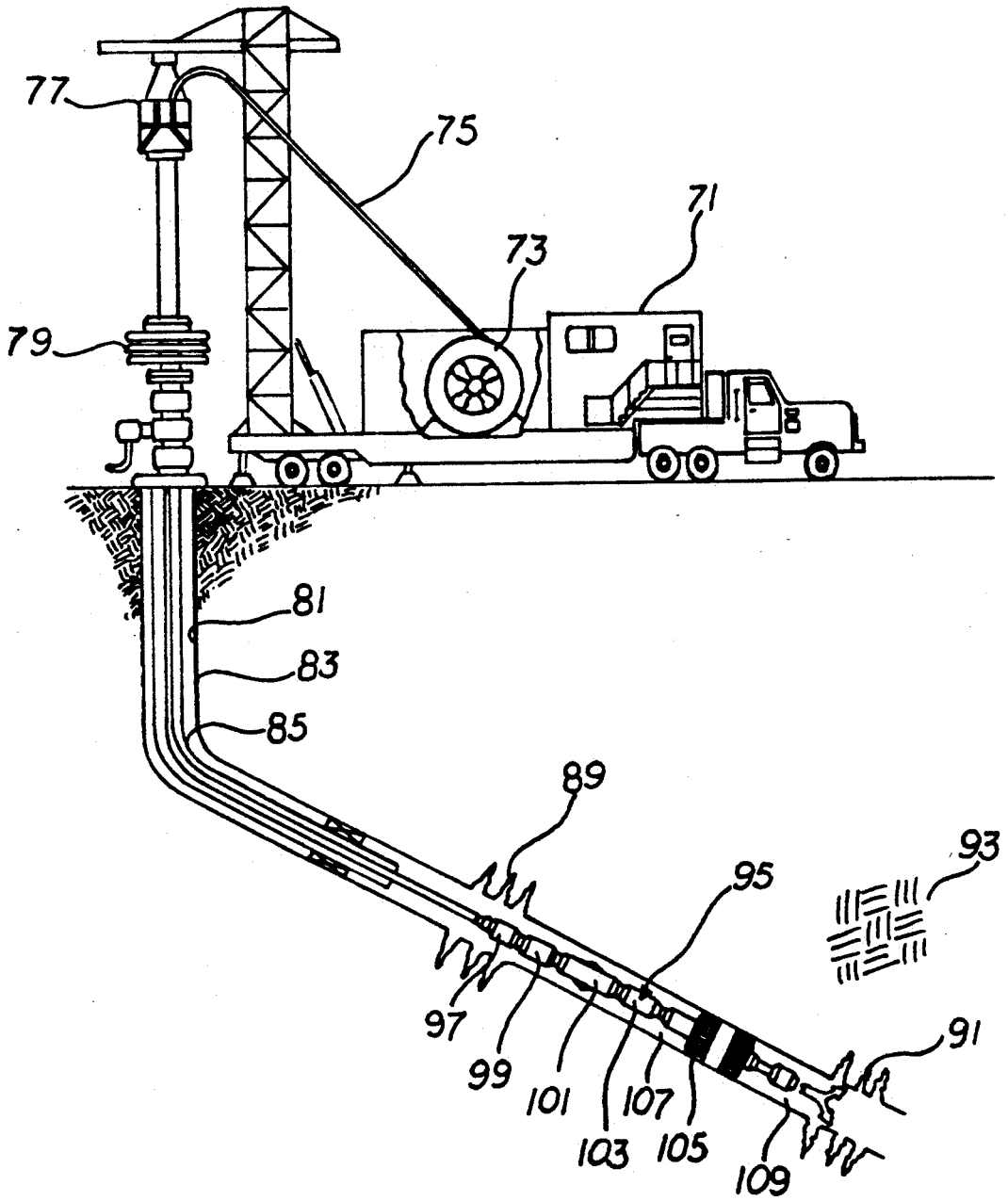
FIGURE 2 PRIOR ART
FIG. 2 is a schematic view of a prior art inflatable wellbore tool suspended within a wellbore on a coiled-tubing string.

FIGS. 1 and 2 depict in schematic form prior art, through-tubing, work-over systems. FIG. 1 is a schematic view of a prior art inflatable wellbore tool 11 suspended within wellbore 13 on a wireline assembly 15. Wellbore 13 includes production tubing string 19 concentrically disposed within casing 17. At the earth's surface 23, a conventional blowout preventer 25 is provided. Wireline assembly 15 includes wireline truck 21 which carries a spool of wireline cable, and an electric power supply 35 which applies electrical energy through electric cable 27 to inflatable wellbore tool 11. Electric cable is directed through guide wheel 29, pulley 31, and lubricator 33, and then fed downward through blowout preventer 25.

As is conventional, production tubing string 19 is packed off at its lower end with inflatable packer 37. Perforations 39, 41 are provided in casing 17 to allow wellbore fluids to pass from formation 43 into wellbore 13.

Inflatable wellbore tool 11 includes a number of components which cooperate together, all of which are prior art devices manufactured, operated, and sold by Baker Service Tools, a division of Baker Hughes Incorporated, having a headquarters in Houston, Tex. Connector 45 is a "rope socket" which serves to connect electric cable 27 to inflatable wellbore tool 11. Collar locator 47 is a device which is used for locating the end of production tubing string 19. Typically, collar locator 47 is an electrical device which detects variation in magnetic flux due to the prescence of casing collars.

Electric motor 48 is connected to the lowermost end of collar locator 47, and includes one or more electric motors which are energized by electricity from power supply 35, which is directed downward into wellbore 13 via electric cable 27. Electric motor 48 provides mechanical power to pump 49, which is connected thereto. Pump 49 is adapted to receive wellbore fluid, and exhausts pressurized wellbore fluid, in small quantities. Typically, pump 49 requires in excess of one hour to completely fill, and set, a standard through-tubing bridge plug. Filter 51 is connected to the output of pump 49, and is adapted to filter debris from the pressurized fluid exhausted from pump 49.

Hydraulic disconnect 53 is connected between bridge plug 55 and filter 51. Preferably, hydraulic disconnect 53 is adapted to disconnect from bridge plug 55, when a predetermined pressure level is exceeded, which is far in excess of the pressure level required for setting of bridge plug 55. Bridge plug 55 is a standard through-tubing bridge plug manufactured by Baker Hughes Incorporated. Bridge plug 55 includes an annular inflatable wall which is composed of an inner elastomeric sleeve, an array of flexible overlapping slats, and an outer elastomeric sleeve. The annular inflatable wall is disposed over an inflation chamber. Fluid is directed into the inflation chamber through valving (which prevents back flow of fluid) to expand to the annular inflatable wall between a deflated running position and an inflated setting position. Typically, bridge plug 55 is set at approximately 1,500 pounds per square inch of area pressure. In FIG. 1, bridge plug 55 is shown in an inflated position, in gripping engagement with casing 17.

As discussed above, when inflatable wellbore tool 11 is lowered within wellbore 13 on wireline assembly 15, through production tubing string 19, the well may be flowing between zones or to the surface from formation 43 into wellbore 13 in response to the pressure differential between formation 43 and wellbore 13. Consequently, a pressure differential may develop between upper region 57 and lower region 59 of wellbore 13 due to the obstruction to flow presented by the inflation of bridge plug 55. As stated above, in an expansion mode of operation, inflatable wellbore tool 11 is urged radially outward from a reduced radial dimension to an intermediate radial dimension which at least in-part obstructs the flow of wellbore fluid within the wellbore in the region of inflatable wellbore tool 11.

This obstruction creates a pressure differential between upper region 57 and lower region 59. If greater pressure is present in upper region 57 than in lower region 59, a downward axial force is exerted on bridge plug 55. In contrast, if a greater pressure exists at lower region 59 than at upper region 57, an upward axial force is applied to bridge plug 55. The pressure differential across bridge plug 55 can be great enough to physically displace bridge plug 55 significant distances within wellbore 13, thus undermining engineering objectives, and perhaps impairing the performance of the oil and gas well. Alternately, the pressure differential across bridge plug 55 can become so great as to accidentally disconnect connector 45 from electric cable 27, causing loss of inflatable wellbore tool 11 within wellbore 13.

A similar problem is present in tubing-conveyed delivery systems, as shown in FIG. 2. As shown, coiled tubing truck 71 includes spool 73 for delivering coiled-tubing 75 to wellbore 81. Coiled-tubing 75 is directed downward through injection head 77 and blowout preventer 79. Coiled-tubing 75 is directed into wellbore 81 through production tubing string 85, which is concentrically disposed within casing 83. As is conventional, production tubing string 85 is packed-off against casing 83 at its lower end. Also, perforations 89, 91 are provided for delivering wellbore fluids, such as oil and water, from formation 93 into wellbore 81 in response to the pressure differential between formation 93 and wellbore 81.

As shown in FIG. 2, inflatable wellbore tool 95 is suspended within wellbore 81 on coiled-tubing string 75. Preferably, inflatable wellbore tool 95 includes a number of components which cooperate together, such as those components manufactured, operated, and offered for sale by Baker Service Tools, a division of Baker Hughes Incorporated. Coiled-tubing connector 97 operates to connect inflatable wellbore tool 95 to coiled-tubing string 75. High pressure fluid is directed downward into wellbore 81 through coiled-tubing string 75 and is received by inflatable wellbore tool 95. Check valve 99 is connected to the lowermost end of coiled-tubing connector 97, and operates to prevent the back flow of fluid upward into coiled-tubing string 75. Tubing ends locator 101 is coupled to check valve 99, and includes dogs which are movable between open and closed positions, which, when expanded, are larger in radial dimension than the inner diameter production tubing string 85. Once inflatable wellbore tool 11 is passed through production tubing string 19, the dogs may be moved into a radially expanded position, and coiled-tubing string 75 may be withdrawn from wellbore 13, until removable dogs engage the end of production tubing string 85. An increase in the weight carried by coiled tubing string 75 indicates that the dogs are in engagement with the lowermost end of production tubing string 85. Hydraulic disconnect 103 is coupled to tubing end locator 101, and operates to release bridge plug 109 from the rest of inflatable wellbore tool 95 when a preselected pressure threshold is exceeded by the fluid directed downward through coiled-tubing string 75.

As bridge plug 105 is inflated from a running mode of operation with a reduced radial dimension to a setting mode of operation in gripping engagement with casing 83, the passage of fluid upward or downward within wellbore 81 is at least in-part obstructed by bridge plug 105. Consequently, a pressure differential may develop between upper region 107 and lower region 109. The pressure differential may operate to displace bridge plug 105, and cause it to be set in a fixed position in an undesirable location, or it may cause hydraulic disconnect 103 to fail, and prematurely release bridge plug 105.

Figure 3:
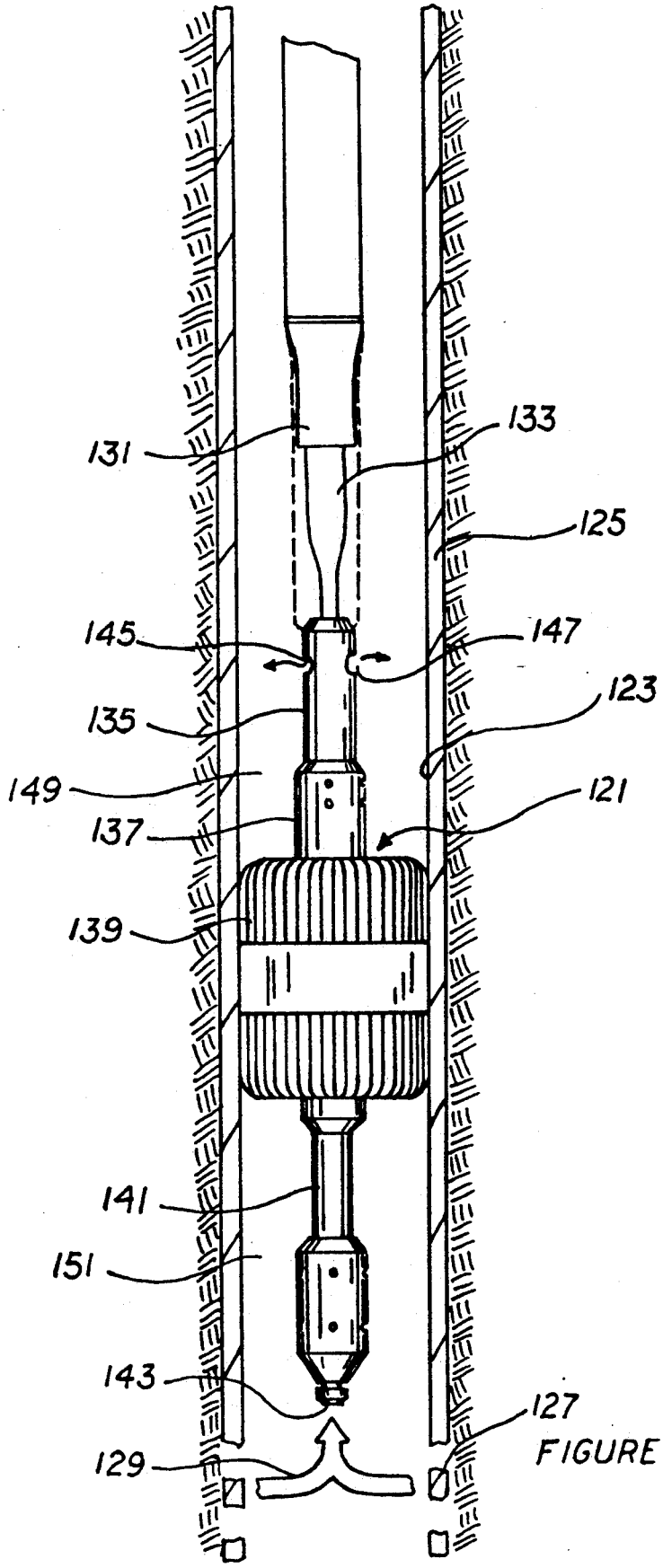
FIG. 3 is a perspective view of one embodiment of the improved settable wellbore tool of the present invention disposed in a cased wellbore.

FIG. 3 is a perspective view of one embodiment of the improved settable wellbore tool 121 of the present invention disposed in wellbore 123, which is caused by casing 125. Casing 125 includes perforations 127 which allow wellbore fluids 129 (including oil and water) to enter wellbore 123. As shown in FIG. 3, settable wellbore tool 121 is releasably coupled to releasable connector 131 (which is shown in phantom). Settable wellbore tool 121 includes fishing neck 133 which facilitates retrieval at a later date.

Settable wellbore tool 121 includes a number of subassemblies which couple together and cooperate to achieve the purposes of the present invention. Of course, fishing neck assembly 133 allows for selective coupling with other components. Fishing neck assembly 133 is shown in longitudinal section view in FIG. 4.

Valving subassembly 135 includes the preferred valving components of the present invention, and is coupled to the lower end of fishing neck assembly 133. Valving subassembly 135 is shown in longitudinal section view in FIG. 5*a*. Poppet valve subassembly 137 is coupled to the lowermost portion of valving subassembly 135, and includes conventional valving which is used to direct high pressure fluid into fluid-actuated wellbore tool 139. Poppet valve assembly 137 is shown in partial longitudinal section view in FIG. 7. In FIG. 3, fluid-actuated by wellbore tool 139 is shown to be a bridge plug, but could be any other wellbore tool, including wellbore tools which are actuated mechanical force, instead of fluid pressure. A bridge plug is depicted in FIG. 3 and discussed in the specification as being representative of other settable wellbore tools including fluid actuated and mechanically actuated wellbore tools, such as conventional packers, and inflatable packers.

Guide subassembly 141 is disposed beneath fluid-actuated wellbore tool 139. Guide assembly is shown in partial longitudinal section view in FIGS. 9*a* and 9*b*. Guide subassembly 141 differs from other, prior art, guide subassemblies in that it includes port 143 at its lowermost end which operates to receive and discharge wellbore fluids. Port 143 is in communication with ports 145, 147 of valving subassembly 135. Ports 143, 145, and 147 are connected together to allow the passage of fluid between upper region 149 and lower region 151.

Therefore, if a pressure differential exists across fluid-actuated wellbore tool 139, fluid will pass between ports 143, 145, 147 to lessen the differential. If upper region 149 has a pressure which is lower than that found at lower region 151, fluid will flow from port 143 to ports 145, 147. Conversely, if pressure at upper region 149 is higher than that found at lower region 151, fluid will flow from ports 145, 147 to port 143. Preferably, in the present invention, the communication of fluid between ports 143, 145, 147 only occurs during specific operating intervals. In particular, communication between ports 143, 145, and 147 is discontinued once fluid-actuated wellbore tool 139 has achieved a setting condition of operation, and is in gripping engagement with casing 125 of wellbore 123.

Figure 4:
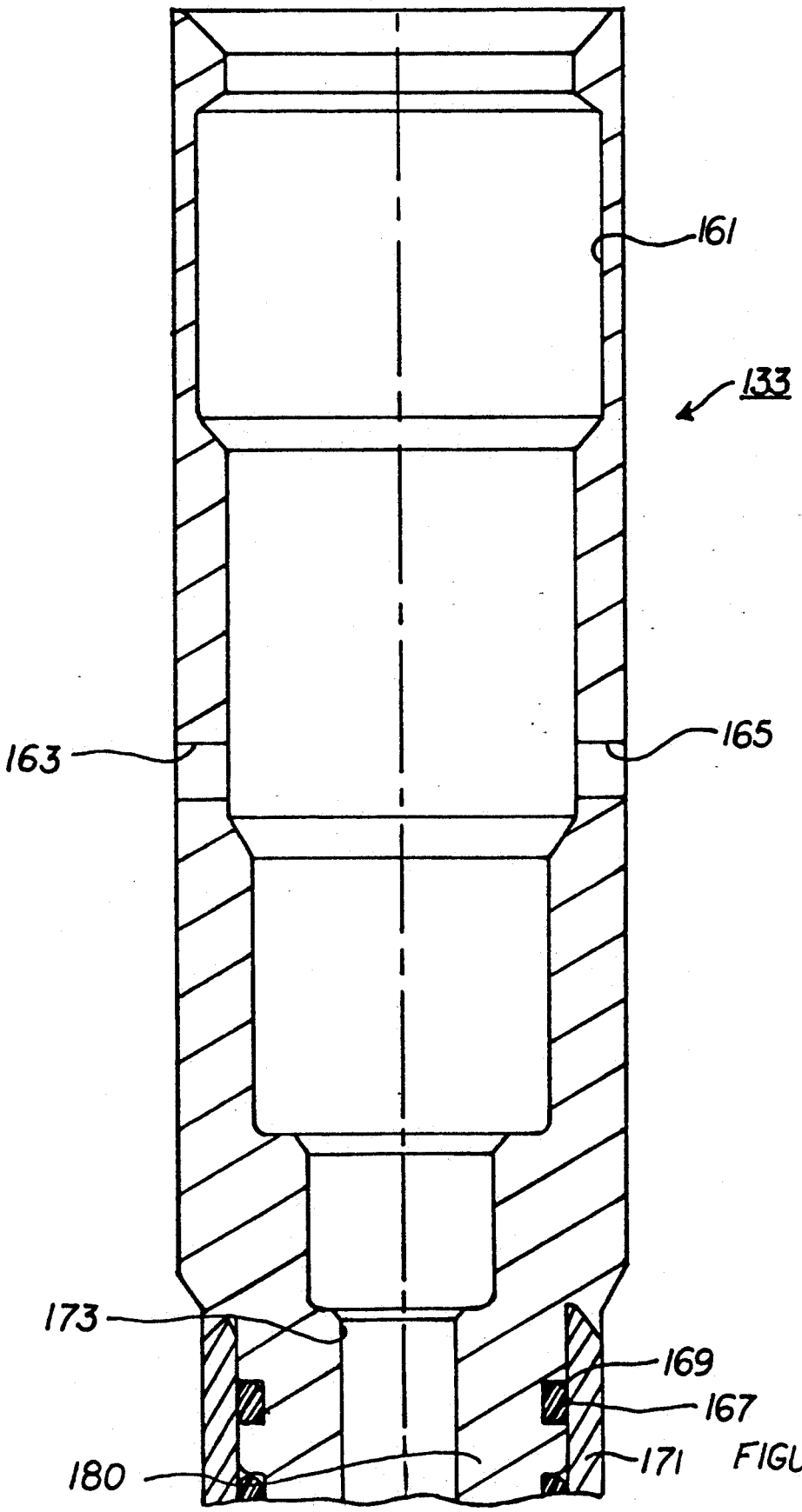
FIG. 4 is a longitudinal section view of an upper fishing-neck subassembly of the preferred settable wellbore tool of the present invention.

FIG. 4 is a longitudinal section view of fishing neck assembly 133 of the preferred settable wellbore tool of the present invention. As shown, fishing neck assembly 133 includes fishing neck profile 161 which is adapted for receiving a fishing tool. Vent ports 163, 165 are provided in fishing neck assembly 133 to facilitate connection of fishing neck assembly 133 with a fishing tool. Preferably O-ring seal 167 is provided in O-ring seal cavity 169 at the lower end of fishing neck assembly 133, at the interface of outer housing 171 of valve subassembly 135. Central bore 173 is defined within fishing neck assembly 133, and is adapted for directing pressurized fluid downward into valving subassembly 135.

Figure 5A:
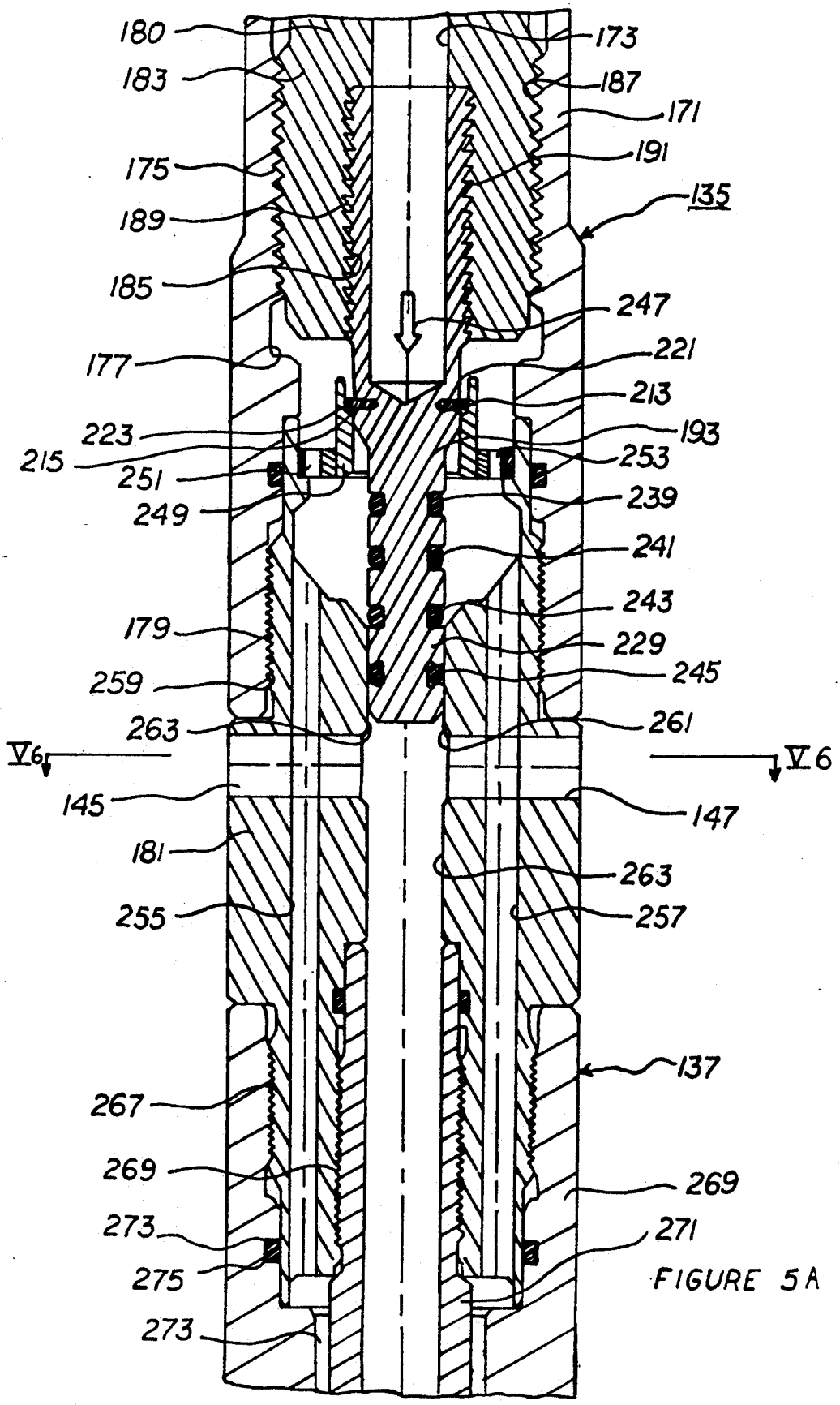
FIG. 5*a* is a longitudinal section view of the preferred valving subassembly of the preferred settable wellbore tool of the present invention.

The preferred settable wellbore tool 121 of the present invention continues on FIG. 5*a*, which is a longitudinal section view of the preferred valving subassembly 135 of the preferred settable wellbore tool 121 of the present invention. FIGS. 4*a* and 5*a* can be read together. As shown in FIG. 5*a*, outer housing 171 of valving subassembly 135 includes upper internal threads 175, and lower internal threads 179. Central cavity 177 is disposed within outer housing 171. The material which forms fish neck assembly 133 terminates at end piece 180, which is disposed within central bore 173 of valve subassembly 135. End piece 180 includes external threads 187 which mate with upper internal threads 175 of outer housing 171. Of course, central bore 173 extends through end piece 180.

End piece 180 serves as a stationary ratchet piece 183, which receives movable ratchet piece 185. Internal ratchet teeth 189 are provided in a recessed region of central bore 173, and are adapted for releasably engaging external ratchet teeth 191 of movable valve stem 193.

Figure 6C:
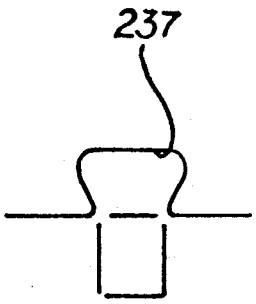
FIGS. 6*a*, 6*b*, and 6*c* depict, in cross-section, the preferred valve stem of the preferred settable wellbore tool of the present invention.
Figure 6B:
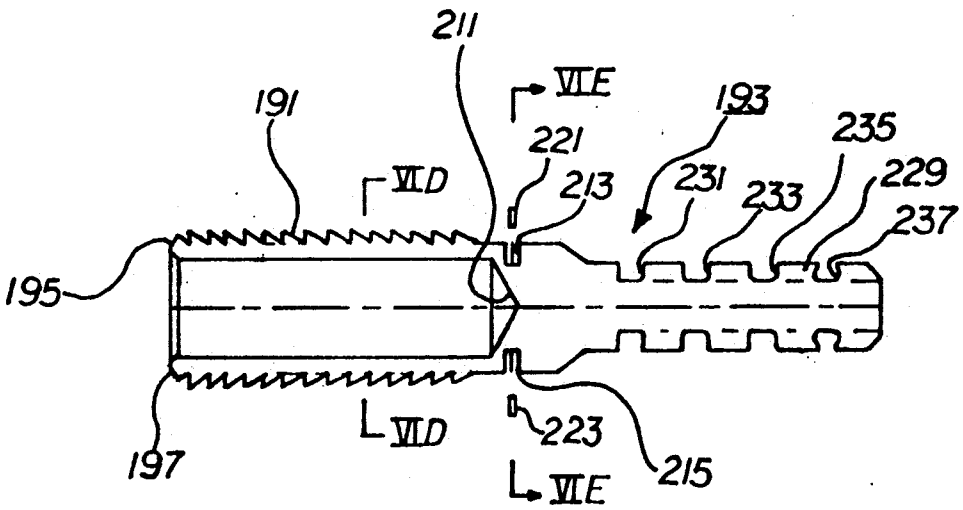
Figure 6A:
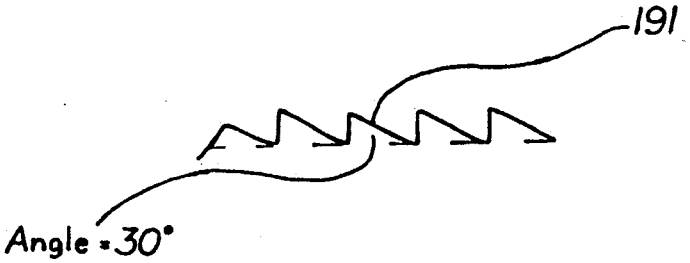
Figure 6D:
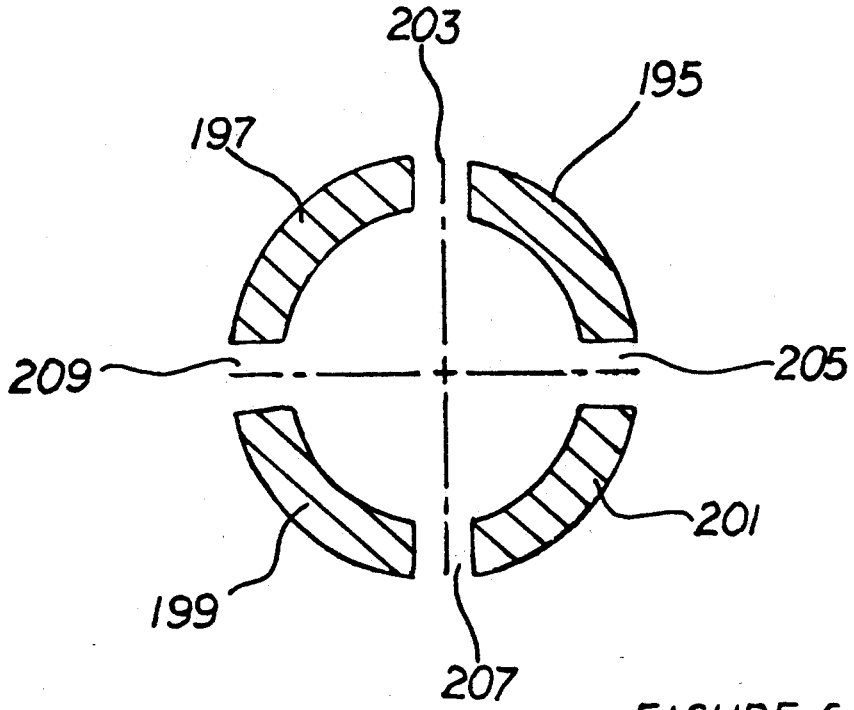
FIGS. 6*d* and 6*e* are cross-section views of the preferred valve stem of the preferred settable wellbore tool of the present invention, as seen along lines VId—VId, and VIe—VIe, respectively of FIG. 6*b;*

FIG. 6*b* depicts movable valve stem 193 detached from the remainder of valving subassembly 135. As shown, movable valve stem 193 includes external ratchet teeth 191 which are disposed at thirty degrees from normal, as shown in FIG. 6*a*. External ratchet teeth 191 are disposed on four "finger-like" collets 195, 197, 199, 201. Collets 195, 197 are shown in the view of FIG. 6*b*. FIG. 6*d* is a cross-section view of movable valve stem 193 as seen along lines VId—VId of FIG. 6*b*. In this view, collets 199, 201 are also visible. As shown, the collets are semi-cylindrical in shape, and are separated by gaps 203, 205, 207, 209. Gaps 203, 205, 207, 209 allow collets 195, 197, 199, 201 to flex slightly radially inward in response to downward pressure exerted upon end 211 of movable valve stem 193.

Figure 6E:
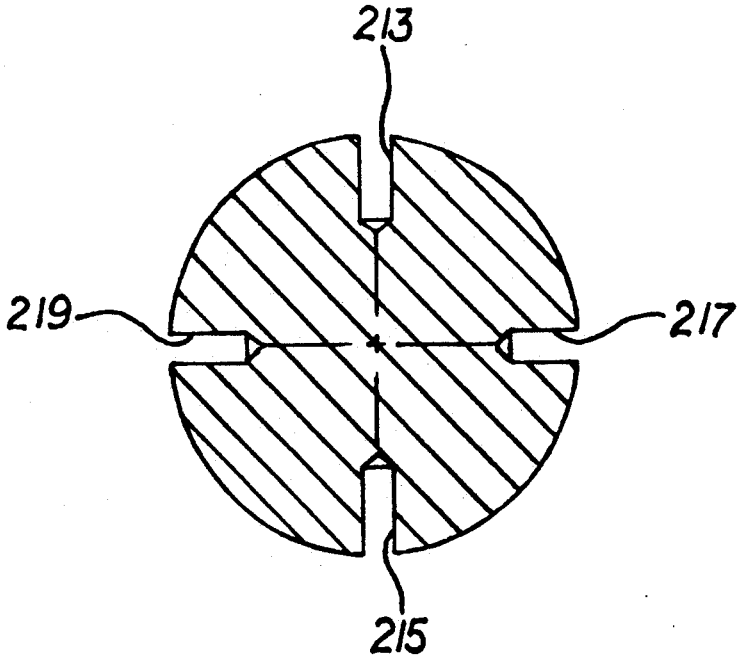

Movable valve stem 193 includes shear pin cavities 213, 215, 217, and 219, which are adapted to receive shear pins 221, 223, 225, and 227. The longitudinal section view of FIG. 6*b* depicts only shear pin cavities 213 and 215. Shear pins 221, 223 are only depicted in FIG. 6*b*. FIG. 6*e* is a cross-section view as seen along lines VIe—VIe of FIG. 6*b*, and depicts all the shear pin cavities 213, 215, 217, 219. FIG. 5*a* shows movable valve stem 193 in full longitudinal section, and thus only depicts shear cavities 213, 215 and shear pins 221, 223.

Returning now to FIG. 6*b*, movable valve stem 193 further includes plug section 229 which is equipped with radial O-ring seal cavities 231, 233, 235, and 237. FIG. 6*b* shows plug section 229 without O-ring seals, but FIG. 5*a* shows plug section 229 equipped with O-ring seals 239, 241, 243, 245, disposed in O-ring seal cavities 231, 233, 235, and 237 respectively. FIG. 6*c* shows the detail of O-ring cavity 237.

Returning now to FIG. 5*a*, it can be seen that movable valve stem 193 is allowed to move only in the direction of arrow 247, since the interior ratchet teeth 189 and exterior ratchet 191 are configured geometrically to allow such movement when collets 195, 197, 199, 201 are flexed slightly radially inward. Shear pins 221, 223, 225, 227 (only shear pins 221, 223 are shown in FIG. 5*a*) mechanically couple movable ratchet piece 185 of movable valve stem 193 to retaining ring 249, which mates against shoulder 251, which is disposed along the inner surface of central cavity 277 of outer housing 171. Shear pins 221, 223, 225, 227 cooperate with retaining ring 249 to prevent of movement of movable valve stem 193 in the direction of arrow 247, until a predetermined force level is exceeded which operates to shear pins 221, 223, 225, 227, and free movable valve stem 293 from the stationary retaining ring 249.

Retaining ring 249 includes fluid flow passages 251, 253. High pressure fluids is directed downward through central bore 173, through gaps 203, 205, 207, 209, and into central cavity 177. Fluid flow passages 251, 253 receive the high pressure fluid from central cavity 177, and direct it past retaining ring 249. High pressure fluid is received by inflation passages 255, 257, which extend axially through valve nipple 181.

Valve nipple 181 includes external threads 259 which are adapted for mating with lower internal threads 179 of outer housing 171. Valve nipple 181 also includes stationary valve seat 261 which includes central bore 263 which is adapted in size and shape to receive plug section 229 of movable valve stem 193. Central bore 263 is adapted for interfacing with O-ring seals 239, 241, 243, and 245, which are carried in O-ring seal cavities 231, 233, 235, 237 of plug section 229 of movable valve stem 193.

Figure 5B:
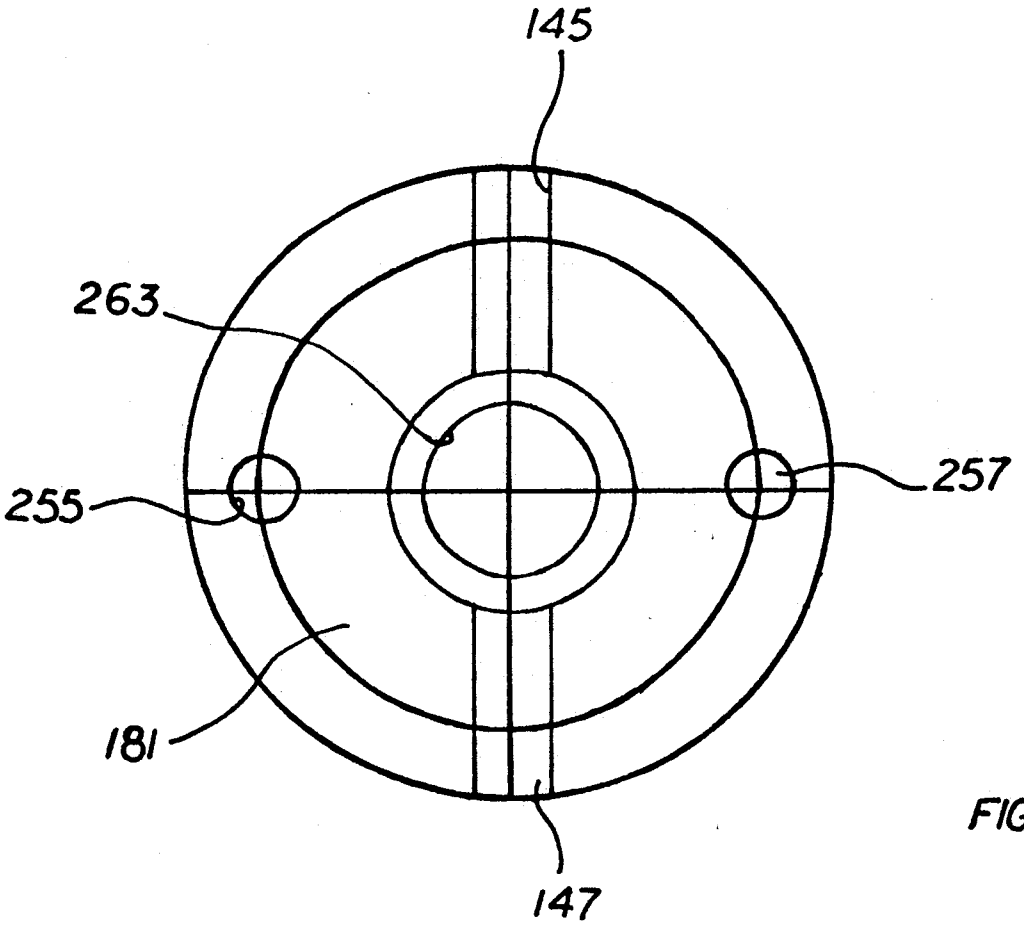
FIG. 5*b* is a cross-section view of the preferred valving subassembly of the preferred settable wellbore tool of the present invention, as seen along lines Va—Va of FIG. 5*a;*

Ports 145, 147 (which are also seen in the perspective view of FIG. 3) extend radially outward from central bore 263 of valve nipple 181. Ports 145, 147 and inflation passages 255, 257 do not intersect or communicate with one another, contrary to the depiction of FIG. 5*a*. FIG. 5*a* (incorrectly) shows ports 145, 147 intersecting with inflation passages 155, 157 for purposes of exposition only. FIG. 5*b* is a cross-section view as seen along lines Vb—Vb of FIG. 5*a*. As shown, inflation passages 255, 257 are aligned in a single plane which is ninety degrees part from the plane which includes ports 145, 147. Central bore 163 communicates only with ports 145, 147, and does not communicate with inflation passages 255, 257.

FIG. 5*a* depicts valving subassembly 135 in a running and inflation mode of operation, in which high pressure inflation fluid is directed downward through central bore 173 of stationary ratchet piece 183, and through gaps 203, 205, 207, 209 between collets 195, 197, 199, 201 of movable valve stem 193. Fluid is then directed through fluid flow passages 251, 253 of retaining ring 249, and into inflation passages 255, 257 of valve nipple 181. High pressure fluid is directed to fluid-actuated wellbore tool 139, of FIG. 3, and urges it from a deflated running position to an inflated setting position. FIG. 3 shows fluid-actuated wellbore tool 139 in an inflated setting position. However, valving subassembly 135 of FIG. 5*a* communicates with port 143 (of FIG. 3) and allows high pressure wellbore fluid to be passed through fluid-actuated wellbore tool 139 (without interfering with the inflation thereof) and into central bore 263 of valve nipple 181, for passage into the annular space between valving subassembly 135 and casing 125 of wellbore 123 (of FIG. 3). This allows the pressure differential developed across fluid-actuated wellbore tool 139 (of FIG. 3) to be lessened. Of course, if the pressure in annular region surrounding valving subassembly 135 exceeds the pressure beneath fluid-actuated wellbore tool 139, fluid may flow downward through ports 145, 147 and exit port 143 (of FIG. 3).

Returning now to FIG. 5*a*, valve nipple 181 further includes external threads 265, and internal threads 267 for mating with poppet valve subassembly 137. Poppet valve subassembly 137 includes poppet housing 269 and mandrel 271, with annular inflation passage 273 disposed therebetween, and in fluid communication with inflation passages 255, 257. O-ring seal cavity 273 and O-ring seal 275 are provided at the interface of valve nipple 181 and poppet housing 269, to prevent leakage of high pressure inflation fluid from inflation passages 255, 257.

Figure 7:
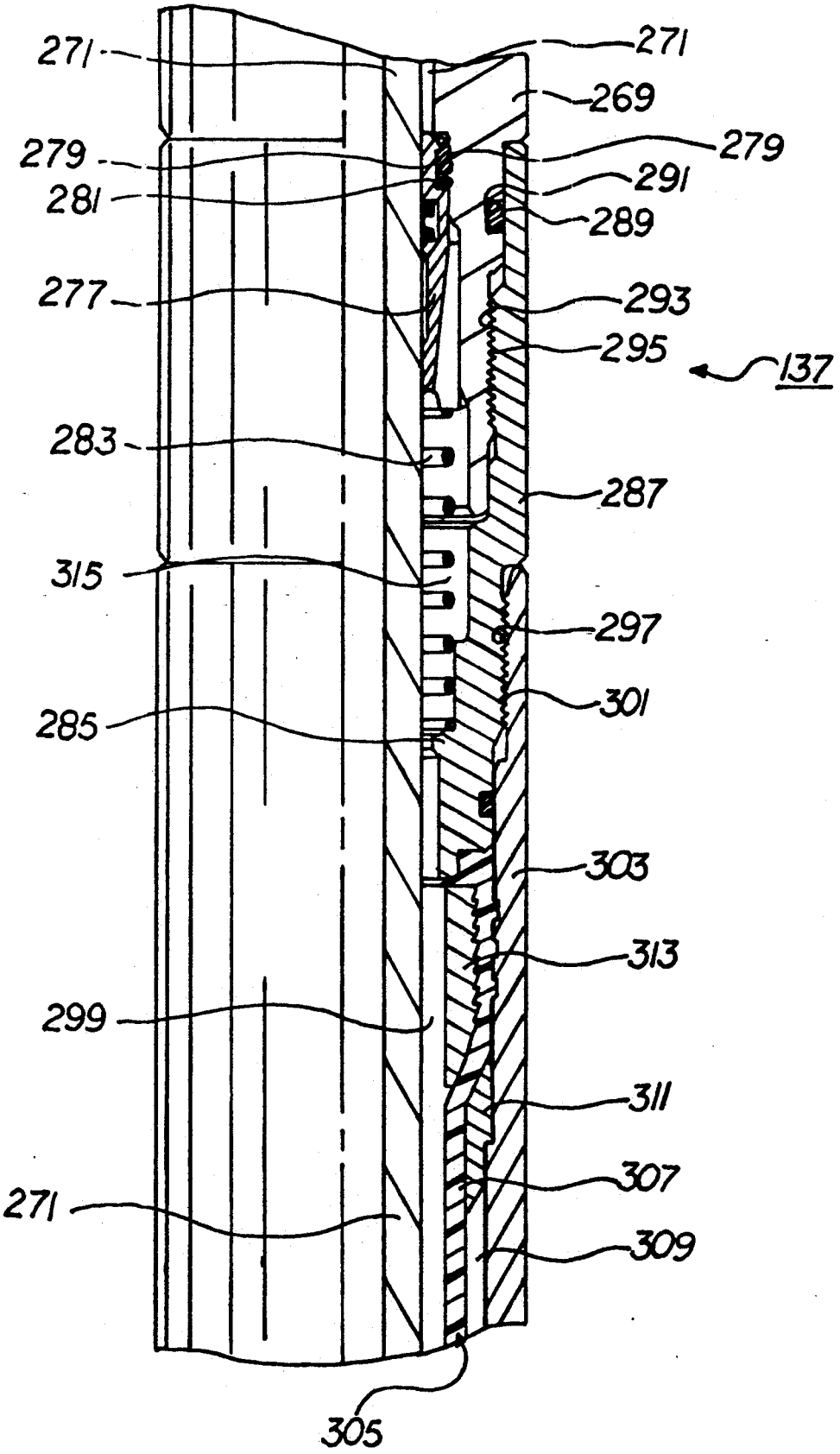
FIG. 7 is a one-quarter longitudinal section view of the preferred poppet valve subassembly of the preferred settable wellbore tool of the present invention.

FIG. 7 is a one-quarter longitudinal section view of poppet valve subassembly 137 with poppet valve 277 disposed between mandrel 271 and poppet housing 269. Poppet valve 277 is biased to sealingly engage internal shoulder 279 of poppet housing 269 with elastomeric seal elements 279, 281 which are bonded to the body of poppet valve 277. Poppet valve 277 is biased upward by poppet spring 283 which is held in a fixed position by engagement with shoulder 285 of connecting member 287. O-ring seal 289, which is disposed in O-ring seal cavity 291, seals the interface of connector member 287 and poppet housing 269, which are threaded together at internal and external threads 294, 295. Connector member 287 includes external threads 297 which are adapted for mating with internal threads 301 of upper bridge plug collar 303.

Annular inflatable wall 305 is disposed between mandrel 271 and upper bridge plug collar 303. Inflation chamber 299 is disposed between annular inflatable wall 205 and mandrel 271. Annular inflatable wall 305 comprises inner elastomeric sleeve 307 and an array of flexible overlapping slats 309. Slat ring 311 is adapted for welding to the interior surface of upper bridge plug collar 303, and operates to hold the array of flexible overlapping slats 309 in a fixed position relative to upper bridge plug collar 303. Inner elastomeric sleeve 307 is disposed between sleeve ring 313 and upper bridge collar 303. Sleeve ring 313 includes teeth which are in gripping engagement with inner elastomeric sleeve 307 and holds it in a fixed position relative to upper bridge plug collar 303.

In operation, when the fluid pressure above poppet valve 277 exceeds the upward force of poppet spring 283, poppet valve 277 is urged downward relative to mandrel 271 and poppet housing 269, to allow high pressure fluid to pass along the inner surface of poppet housing 269, and flow downward through central passage 315 (in which poppet spring 283 resides), and into inflation chamber 299. The high pressure fluid acts to outwardly radially expand annular inflatable wall 305 and move it between a deflated running position and an inflated setting position.

Figure 8A:
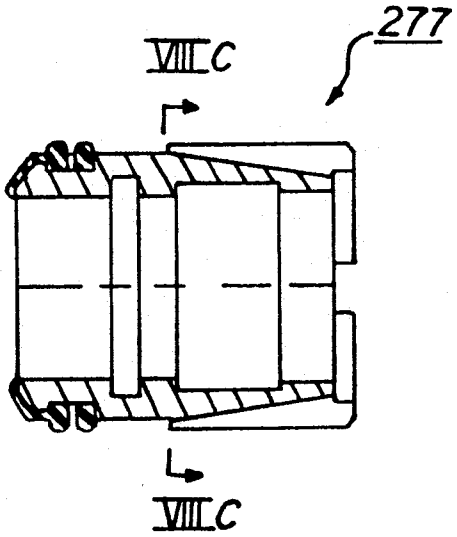
FIGS. 8*a*, 8*b*, and 8*c* are detailed longitudinal, fragmentary longitudinal, and cross-section views, respectively, of the preferred poppet valve stem of the preferred settable wellbore tool of the present invention.
Figure 8B:
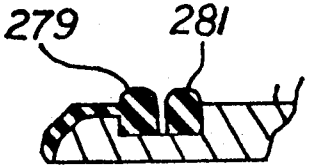
Figure 8C:
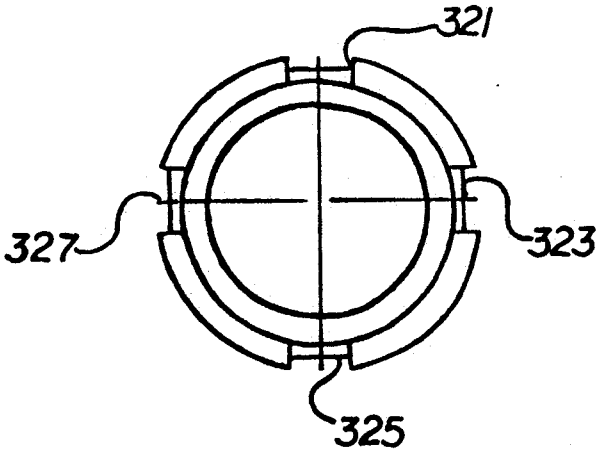

FIGS. 8*a*, 8*b* and 8*c* show more detail about poppet valve 277. FIG. 8*a* shows poppet valve 277 in longitudinal section. FIG. 8*b* is an enlarged view of the sealing portion of poppet valve 277 and depicts how elastomeric elements 279, 281 are bonded to the exterior surface of the steel cylinder which forms poppet valve 277. FIG. 8*c* is a cross-section view as seen along lines VIIIc—VIIIc of FIG. 8*a*. As shown, poppet valve 277 includes a plurality of slots 321, 323, 325, and 327 which extend axially along the length of poppet valve 277, and facilitate the passage of fluid around poppet valve 277 when high pressure fluid forces it downward relative to poppet housing 269.

Figure 9A:
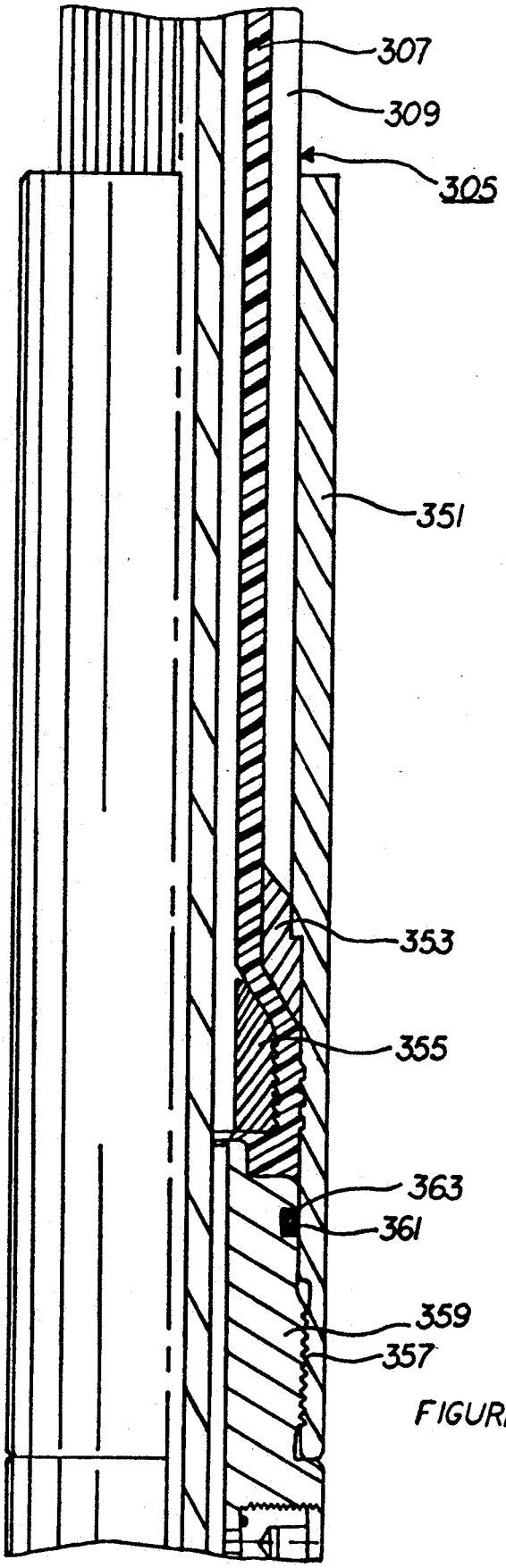
FIGS. 9*a* and 9*b* are one-quarter longitudinal section views of the guide subassembly of the preferred settable wellbore tool of the present invention, and are read together.
Figure 9B:
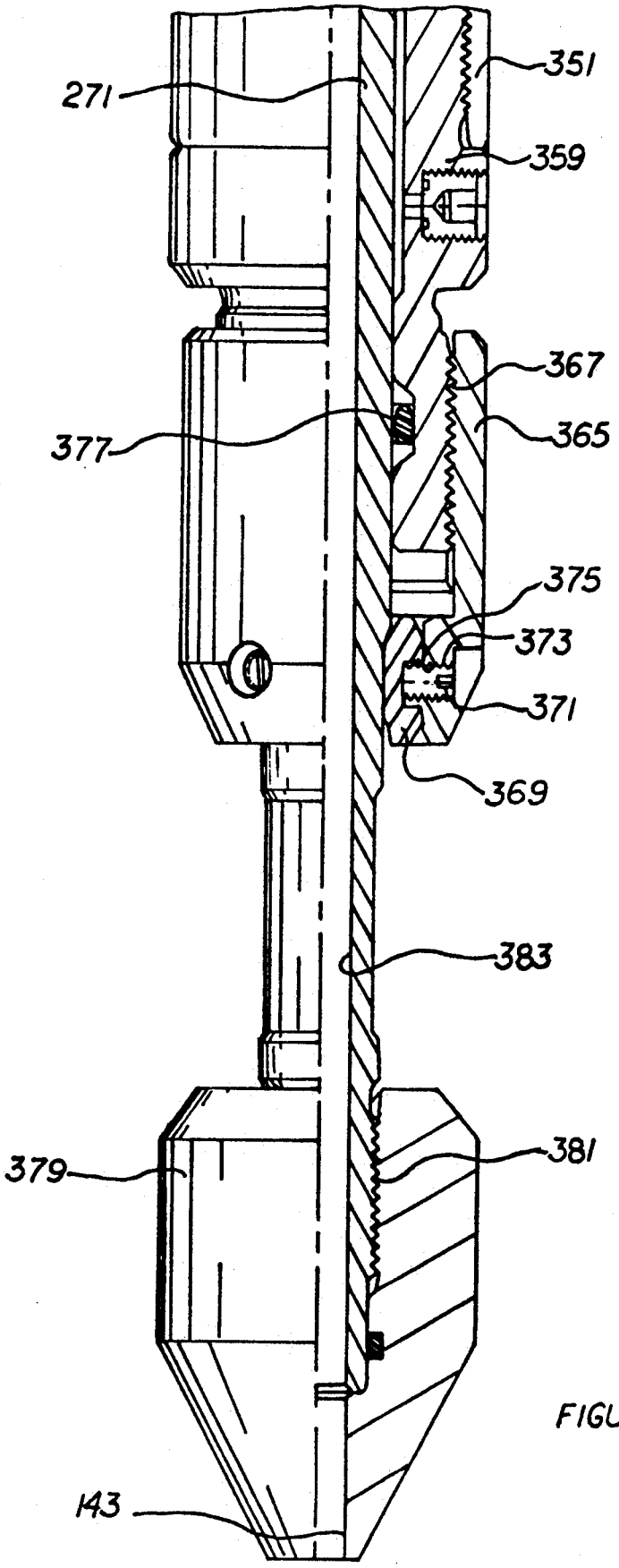

FIG. 9*a* and 9*b* are one-quarter longitudinal section views, which are read together, which depict lower bridge plug collar 351 (of FIG. 3) and the guard assembly 141. As shown, annular inflatable wall 305, which includes inner elastomeric sleeve 307 and an array of flexible overlapping slats 309, is coupled to lower bridge plug collar 351 in a manner similar to that of upper bridge plug collar 303. Specifically, slat ring 353 is welded in place relative to lower bridge plug collar 351, and sleeve ring 355 serves to grippingly engage inner elastomeric sleeve 307 and hold it in position relative to lower bridge plug collar 351.

Lower bridge plug collar 351 is connected at threads 357 to connector sleeve 359, and is sealed at O-ring seal 361, which resides in O-ring seal cavity 363 of connector sleeve 59. Connector sleeve 359 serves to mechanically interconnect lower bridge plug collar 351 and shear adapter sleeve 365, which it is coupled to by threads 367. Shear adapter sleeve 365 is shearably connected to anchor ring 369 by shearable screw 371 which is coupled by threads 373 in shearable screw cavity 375. A plurality of similar shearable screws are provided circumferentially around shear adapter sleeve 365. The number, cross-sectional area, and structural strength of each shear screw additively combine to determine a force threshold which must be exceeded to shear adapter sleeve 365 loose from anchor ring 369. This shearable connection is provided to allow annular inflatable wall 305 to contract axially relative to mandrel 271. Connector sleeve 269 is sealed at its interface with mandrel 271 by sealing ring 377. At its lowermost end, guard subassembly 141 includes guard 379 which is connected by threads 381 to mandrel 271. Port 143 is provided in guard 379 to allow fluid communication inward along central bore 383 which is in continuous fluid communication through the bridge plug and poppet valve subassembly 137, with central bore 261 of valving subassembly 135.

Therefore, with reference now to FIG. 5*a*, the fluid pressure at port 143 of guard 379 is at one side of movable valve stem 193, while the pressure from the source of pressurized fluid (which serves to inflate the bridge plug) is on the opposite side of movable valve stem 193. Shear pins 221, 223, 225, and 227 provide a predetermined force threshold which must be exceeded by the fluid pressure differential across movable valve stem 193 in order to move movable valve stem 193 downward relative to valve nipple 181 for closure of ports 145, 147. The pressure threshold which is selected for initiation of movable valve stem 193 should be coordinated with the particular fluid-actuated wellbore tool which is selected for use. For example, when a bridge plug is selected, as shown in this embodiment, it is important to keep in mind that the typical bridge plug is in gripping engagement with the casing of the wellbore wall, and thus in a fixed position, in the range of inflation pressures between one 1,000 pounds per square inch and approximately 1,500 pounds per square inch. Therefore, by selecting shear pins 221, 223, 225, 227, of a predetermined strength, flow between ports 143, 145, 147 (of FIG. 3) can continue until the bridge plug, or other settable wellbore tool, is in a fixed position relative to the wellbore. Therefore, in the embodiment shown it would be prudent to allow for closure of downward movement of movable valve stem 193, and resulting closure of ports 145, 147 in the range 1,000–1,500 pounds per square inch of pressure within inflation chamber 299 of the bridge plug.

Figure 10:
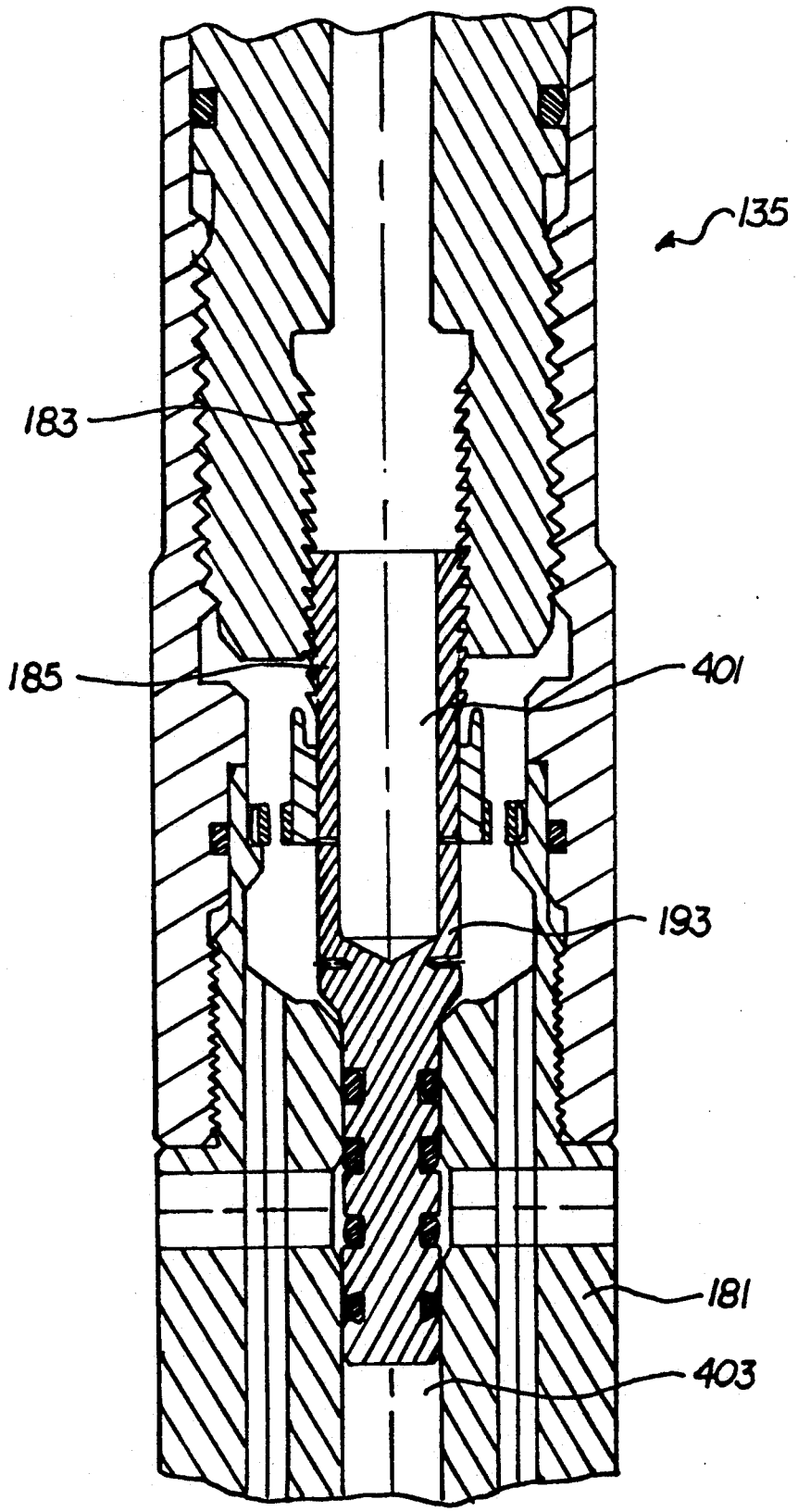
FIG. 10 is a longitudinal section view of the preferred valving subassembly of the preferred settable wellbore tool of the present invention, in a setting mode of operation.

FIG. 10 is a longitudinal section view of valving subassembly 135 with movable valve stem 193 moved into a "closed" position relative to valve nipple 181. As shown, the fluid pressure in region 401 has exceeded the fluid pressure in region 403 by the amount of force required to shear pins 221, 223, 225, and 227, as well as the force required to move movable ratchet piece 185 (which comprise collets 195, 197, 199, and 201) relative to stationary ratchet piece 183. The amount of force required to move movable ratchet piece 185 relative to stationary ratchet piece may be designed to be a small value, so that the total force required to move movable valve stem 193 into a "closed" position relative to valve nipple 188 comprises the force required to shear shear pins 121, 123, 125, 127.

In summary, with reference to FIGS. 3, 5*a*, and 10, the present invention allows for fluid flow between upper region 149 and lower region 151 of wellbore 123. Specifically, fluid is allowed to flow between ports 143, 145, and 147, until a predetermined inflation pressure is obtained within the inflation chamber of the fluid-actuated wellbore tool 139. This pressure level corresponds with the pressure differential which must be developed across movable valve stem 193 in order to shear shear pins 121, 123, 125, 127, and move movable ratchet piece 185 relative to stationary ratchet piece 183. Preferably, this pressure level is selected so that fluid-actuated wellbore tool 139 is completely set and fixed in position relative to casing 125. At this point, it is safe to close off communication between ports 143, 145, and 147 to prevent the flow of fluid across fluid-actuated wellbore tool 139.

While the invention has been shown in only one of its forms, it is not thus limited but is susceptible to various changes and modifications without departing from the spirit thereof.

What is claimed is:

1. An apparatus for use to grippingly and sealingly engage a wellbore surface within a wellbore having a wellbore fluid flowing therein for preventing said wellbore fluid flow therethrough, said apparatus comprising:

a settable wellbore tool for use in downhole oil and gas operations which is operable in a plurality of operating modes including a running mode of operation with a reduced radial dimension, an expansion mode of operation in which said settable wellbore tool is urged radially outward from said reduced radial dimension to an intermediate radial dimension, and a setting mode of operation in which said settable wellbore tool is further radially expanded into a setting radial dimension and urged into a fixed position within said wellbore for grippingly and sealingly engaging said wellbore surface, wherein flowing of said wellbore fluid may create a pressure differential across said settable wellbore tool during at least said expansion mode of operation, said pressure differential urging said settable wellbore tool to move longitudinally within said wellbore;

a bypass fluid flow path extending through said settable wellbore tool to direct said wellbore fluid through said settable wellbore tool in response to said pressure differential developed across said settable wellbore tool for preventing said pressure differential from urging said settable wellbore tool to move longitudinally within said wellbore prior to said settable wellbore tool radially expanding to attain a sufficient level of said setting mode of operation to grippingly engage said wellbore surface with enough force to prevent said settable wellbore tool from moving longitudinally within said wellbore with said bypass fluid flow path closed;

a means for selectively maintaining said bypass fluid flow path in an open condition during at least said expansion mode of operation to diminish said pressure differential developed across said settable wellbore tool and prevent said pressure differential from urging said settable wellbore tool from moving longitudinally within said wellbore;

a means for selectively closing said bypass fluid flow path and preventing said wellbore fluid from flowing therethrough after said sufficient level of said setting mode of operation is obtained and said settable wellbore tool grippingly engages said wellbore surface with enough force to prevent said settable wellbore tool from moving longitudinally within said wellbore once said bypass fluid flow path is closed; and a latch having at least one collet-finger member which couples with a mating member for retaining said by pass fluid flow path closed once said means for selectively closing said by pass fluid flow path selectively closes said bypass fluid flow path.

2. The apparatus of claim 1, wherein said means for selectively closing said bypass fluid flow path includes a valving subassembly having:

a movable valve stem, wherein said movable valve stem is selectively movable at least once from an open state to a closed state by application of a predetermined force pressing against said movable valve stem with a selected force threshold, said predetermined force applied to said settable wellbore tool through a control fluid; and a valve closure surface included as a portion of said movable valve stem of said valving subassembly, said valve closure surface in contact with said control fluid, wherein a high pressure level in said control fluid urges said movable valve stem to close said bypass fluid flow path; and a mechanical biasing means which at least in part prevents movement of said valve closure surface of said movable valve stem until said control fluid exceeds a predetermined pressure level.

3. The apparatus of claim 1, wherein said settable wellbore tool is lowered downhole within said wellbore through a tubular conduit, which has an internal diameter which is smaller than said settable wellbore tool in a setting mode of operation, and said settable wellbore tool is urged into said fixed position in said wellbore below said tubular conduit during said setting mode of operation, and wherein said wellbore has larger internal diameter than said tubular conduit.

4. An apparatus according to claim 1, further comprising:

said settable wellbore tool including an inflation chamber having a radially expandable annular wall disposed thereabout, said radially expandable annular wall being selectively expandable by application of a setting pressure through an actuation fluid to said inflation chamber of said settable wellbore tool wherein flowing of said wellbore fluid flow inside of said wellbore may create a pressure differential across said settable wellbore tool which urges said settable wellbore tool to move within said wellbore; and means for providing an actuation fluid which provides a selectable pressure level to said settable wellbore tool and which urges said settable wellbore tool to radially expand from said running mode of operation to said expansion mode of operation and further to said setting mode of operation, wherein after said settable wellbore tool is run into said wellbore, said actuation fluid is selectively applied to said settable wellbore tool to initiate said expansion mode of operation in which said settable wellbore tool is urged to radially expand outward.

5. An apparatus according to claim 4, wherein said settable wellbore tool is positioned within said wellbore by a flexible suspension member which includes a coiled tubing string which at least in part routes actuation fluid to said settable wellbore tool.

6. An apparatus according to claim 4, wherein said settable wellbore tool is positioned within said wellbore by a flexible suspension member which includes an electric wireline which energizes a wellbore pump for providing said actuation fluid to said settable wellbore tool.

7. The apparatus of claim 4, wherein said means for selectively closing said bypass fluid flow path, which operates after said setting mode of operation is obtained, automatically closes said bypass fluid flowpath in response to said actuation fluid pressure exceeding said selectable fluid pressure level.

8. An apparatus for use in a wellbore for reducing pressure differential forces caused by wellbore fluid flowing through said wellbore and which act on a settable wellbore tool which is suspended in said wellbore on a suspension member, wherein said settable wellbore tool is operable in a plurality of operating modes including a running mode of operation with a reduced radial dimension, an expansion mode of operation in which said settable wellbore tool is urged radially outward from said reduced radial dimension to an intermediate radial dimension which at least in-part obstructs flow of said wellbore fluid within said wellbore in a region of said settable wellbore tool and creates a pressure differential across said settable wellbore tool, and a setting mode of operation in which said settable wellbore tool is further radially expanded into a setting radial dimension and urged into a fixed position within said wellbore in a gripping engagement with a wellbore surface, said apparatus comprising:

a bypass fluid flow path extending through said settable wellbore tool for directing said wellbore fluid through said settable wellbore tool in response to said pressure differential developed across said settable wellbore tool during said expansion mode of operation;

a means for selectively maintaining said bypass fluid flow path in an open condition during at least said expansion mode of operation to diminish said pressure differential developed across said settable wellbore tool;

a means for selectively closing said bypass fluid flow path once said setting mode of operation is obtained to prevent fluid flow therethrough, said means for selectively closing said bypass fluid flow path including a valving subassembly having a moveable valve stem, wherein said moveable valve stem is selectively moveable at least once from an open state to a closed state by application of a predetermined force amount above a selected force threshold to said settable wellbore tool through a control fluid;

said moveable valve stem having a valve closure surface in contact with said control fluid, wherein a selectable pressure level in said control fluid urges said movable valve stem to close said bypass fluid flow path; and a mechanical biasing means which at least in-part prevents movement of said valve closure surface of said moveable valve stem until said control fluid exceeds a predetermined pressure level, said mechanical biasing means comprised at least in part of at least one fingerlike collet with external ratchet teeth disposed around said fingerlike collet for engagement with mating ratchet teeth on said moveable valve stem, wherein said at least one fingerlike collet retains said moveable valve stem from moving to close said bypass fluid flowpath until said control fluid supplies a predetermined force amount above a selected force threshold which causes said at least one fingerlike collet to be displaced by a resulting bending movement.

9. A method for reducing pressure differential forces in a wellbore across a settable wellbore tool to prevent said pressure differential from urging said settable wellbore tool to move within said wellbore, wherein said pressure differential forces are caused by a wellbore fluid flowing across said settable wellbore tool suspended in said wellbore on a suspension member, said method comprising the steps of:

operating said settable wellbore tool in a plurality of operating modes including a running mode of operation with a reduced radial dimension, an expansion mode of operation in which said settable wellbore tool is urged radially outward from said reduced radial dimension to an intermediate radial dimension, and a setting mode of operation in which said settable wellbore tool is further radially expanded into a setting radial dimension and urged into a fixed position within said wellbore for grippingly engaging a wellbore surface, wherein when said settable wellbore tool is urged to radially expand in said expanding mode;

preventing said pressure differential from urging said settable wellbore tool to move within said wellbore prior to said settable wellbore tool attaining said setting mode of operation for grippingly engaging said wellbore surface by providing a bypass fluid flow path extending through said settable wellbore tool to direct said wellbore fluid through said settable wellbore tool in response to said pressure differential developed across said settable wellbore tool;

selectively maintaining said bypass fluid flow path in an open condition during at least said expansion mode of operation to diminish said pressure differential developed across said settable wellbore tool;

selectively closing said bypass fluid flow path after said setting mode of operation is obtained to prevent fluid flow therethrough in response to an actuation fluid pressure which urges said settable wellbore tool from said running mode of operation, to said expansion mode of operation and further to said setting mode of operation;

wherein said settable wellbore tool grippingly and sealingly engages said wellbore surface to prevent said wellbore fluid from flowing between said settable wellbore tool and said wellbore surface;

wherein said settable wellbore tool includes a fluid inflatable packer which is inflated by an actuation fluid;

passing said actuation fluid, having an actuation fluid pressure, to said fluid inflatable packer from a source of actuation fluid;

automatically closing said bypass fluid flow path once said settable wellbore tool is sufficiently urged to said setting mode of operation to prevent movement of said settable wellbore tool with said bypass fluid flow path closed;

wherein said bypass fluid flow is automatically closed by said actuation fluid pressure urging said settable wellbore tool to radially expand into said setting mode of operation; and latching said bypass fluid flow path closed by coupling at least one collet finger member with a mating latch member.

10. The method of claim 9, further comprising the step of:

lowering said settable wellbore tool downhole within said wellbore secured to a coiled tubing string.

11. The method of claim 9, further comprising the step of:

lowering said settable wellbore tool downhole within said wellbore secured to a wireline as part of a wireline tool string, which includes an electric pump for delivering said actuation fluid to said settable wellbore tool and providing said actuation fluid pressure.

12. A settable wellbore tool for use in a wellbore having a wellbore fluid flowing therein, said settable wellbore tool selectively operable to radially expand from a radially reduced dimension, for lowering downhole within a wellbore surface of said wellbore, to a radially enlarged dimension in which said settable wellbore tool is urged to grippingly engage said wellbore surface, said settable wellbore tool comprising:

an actuation fluid having an actuation fluid pressure provided by a fluid pressurization source which directs said actuation fluid to said settable wellbore tool;

an actuation fluid flowpath extending to said settable wellbore tool, and providing a fluid flow path for said actuation fluid to flow into said settable wellbore tool;

a fluid actuated wellbore tool disposed about a portion of said actuation fluid flowpath for receipt of said actuation fluid, said fluid actuated wellbore tool including:

a mandrel disposed concentrically within said fluid actuated wellbore tool, having a bypass fluid flowpath extending therein, and defining a portion of said actuation fluid flowpath;

an inflation chamber concentrically disposed about said mandrel for receiving said actuation fluid directed from said fluid pressurization source, and wherein said actuation fluid directed into said inflation chamber urges an expansion of said inflation chamber from a deflated running position to an inflated setting position;

an annular inflatable wall concentrically disposed about said inflation chamber;

wherein said expansion of said inflation chamber from a deflated running position to an inflated setting position urges a radial expansion of said annular inflatable wall from an unexpanded running position for allowing passage of said settable wellbore tool within said wellbore surface, to a radially expanded position for grippingly engaging said wellbore surface;

wherein said radial expansion of said annular inflatable wall restricts flow of said wellbore fluid and creates a pressure differential across said fluid actuated wellbore tool which urges said settable wellbore tool to move longitudinally within said wellbore;

said bypass fluid flow path extending within said settable wellbore tool to provide a fluid flowpath within which said wellbore fluid flows therethrough in response to said pressure differential across said fluid actuated wellbore tool for preventing said pressure differential from urging said settable wellbore tool to move longitudinally within said wellbore prior to said actuation fluid urging said annular inflatable wall to grippingly engage said wellbore surface with a sufficient level of force to, at least in part, prevent said pressure differential from urging said settable wellbore tool to move longitudinally within said wellbore with said bypass fluid flow path closed;

a valving assembly disposed about said bypass fluid flow path and selectively moveable into said bypass fluid flow path for preventing said wellbore fluid flow therethrough once said annular inflatable wall is urged into said sufficiently inflated position having said sufficient level of said gripping engagement with said wellbore surface to, at least in part, prevent said pressure differential from urging said settable wellbore tool to move longitudinally within said wellbore after said bypass fluid flow path is closed; and a latch having at least one collet-finger member which couples with a mating member for retaining said valving assembly within said bypass fluid flow path once said valving assembly is selectively moved into said by pass fluid flow path to prevent said wellbore fluid for flowing therethrough.

13. The settable wellbore tool of claim 12, having said annular inflatable wall of said inflatable wellbore tool, wherein said annular inflatable wall includes:

a packing sleeve concentrically disposed around said mandrel and said inflation chamber for sealingly engaging said wellbore surface when urged to sealingly engage said wellbore surface; and a plurality of flexible overlapping slats disposed around said mandrel and said inflation chamber, and concentrically disposed about said elastomeric sleeve for reinforcement of said elastomeric sleeve.

14. The settable wellbore tool of claim 12, wherein said fluid pressurization source is a wireline pump which urges said actuation fluid within said inflation chamber to a preselected fluid pressure differential having an actuation fluid pressure sufficiently greater than a wellbore pressure of said wellbore fluid about said settable wellbore tool to urge said annular inflatable well to grippingly and sealingly engage said wellbore surface;

wherein said actuation fluid within said inflation chamber at said actuation fluid pressure urges said inflation chamber into said setting position and said annular inflatable wall to grippingly and sealingly engage said wellbore surface with said sufficient level of force; and wherein said actuation fluid within said inflation chamber at said actuation fluid pressure automatically urges a movable valve stem and a plug section to move into a sealing engagement within said bypass fluid flow path for preventing said wellbore fluid from flowing therethrough.

15. The settable wellbore tool of claim 12, having said annular inflatable wall of said inflatable wellbore tool, wherein said annular inflatable wall includes:

a packing sleeve concentrically disposed around said mandrel and said inflation chamber for sealingly engaging said wellbore surface when urged to sealingly engage said wellbore surface.

16. The settable tool of claim 12, wherein said settable wellbore tool is lowered within said wellbore secured to a coiled tubing string through which said actuation fluid flows in passing between said fluid pressurization source and said settable wellbore tool.

17. A settable wellbore tool for use in a wellbore having a wellbore fluid flowing therein, said settable wellbore tool selectively operable to radially expand from a radially reduced dimension, for lowering downhole within a wellbore surface of said wellbore, to a radially enlarged dimension in which said settable wellbore tool is urged to grippingly engage said wellbore surface, said settable wellbore tool comprising:

an actuation fluid having an actuation fluid pressure provided by a fluid pressurization source which directs said actuation fluid to said settable wellbore tool;

an actuation fluid flowpath extending to said settable wellbore tool, and providing a fluid flow path for said actuation fluid to flow into said settable wellbore tool;

a fluid actuated wellbore tool disposed about a portion of said actuation fluid flowpath for receipt of said actuation fluid, said fluid actuated wellbore tool including:

a mandrel disposed concentrically within said fluid actuated wellbore tool, having a bypass fluid flowpath extending therein, and defining a portion of said actuation fluid flowpath;

an inflation chamber concentrically disposed about said mandrel for receiving said actuation fluid directed from said fluid pressurization source, and wherein said actuation fluid directed into said inflation chamber urges an expansion of said inflation chamber from a deflated running position to an inflated setting position;

an annular inflatable wall concentrically disposed about said inflation chamber;

wherein said expansion of said inflation chamber from a deflated running position to an inflated setting position urges a radial expansion of said annular inflatable wall from an unexpanded running position for allowing passage of said settable wellbore tool within said wellbore surface, to a radially expanded position for grippingly engaging said wellbore surface;

wherein said radial expansion of said annular inflatable wall restricts flow of said wellbore fluid and creates a pressure differential across said fluid actuated wellbore tool which urges said settable wellbore tool to move longitudinally within said wellbore;

said bypass fluid flow path extending within said settable wellbore tool to provide a fluid flowpath within which said wellbore fluid flows therethrough in response to said pressure differential across said fluid actuated wellbore tool for preventing said pressure differential from urging said settable wellbore tool to move longitudinally within said wellbore prior to said actuation fluid urging said annular inflatable wall to grippingly engage said wellbore surface with a sufficient level of force to, at least in part, prevent said pressure differential from urging said settable wellbore tool to move longitudinally within said wellbore with said bypass fluid flow path closed;

a valving assembly disposed about said bypass fluid flow path and selectively moveable into said bypass fluid flow path preventing said wellbore fluid flow therethrough once said annular inflatable wall is urged into said sufficiently inflated position having said sufficient level of said gripping engagement with said wellbore surface to, at least in part, prevent said pressure differential from urging said settable wellbore tool to move longitudinally within said wellbore after said bypass fluid flow path is closed;

said valving assembly including:

a moveable valve stem concentrically disposed within said valving assembly and having at least one ratchet tooth;

a plurality of longitudinally extending collet fingers which engage said at least one ratchet tooth to prevent movement of said moveable valve stem in a first longitudinal direction of said settable wellbore tool, and which further flex to allow movement of said moveable valve stem in a second longitudinal direction of said settable wellbore tool;

a plug section concentrically disposed within said valving assembly and at least adjacent to said bypass fluid flowpath, said plug section secured to said moveable valve stem wherein a movement of said moveable valve stem in said second longitudinal direction urges said plug section into a sealing engagement within said bypass fluid flowpath; and at least one shearable element disposed adjacent to said moveable valve stem to, at least in part, maintain said moveable valve stem against movement in a said second longitudinal direction until a preselected fluid pressure differential is applied to said actuation fluid within said inflation chamber.

18. A settable wellbore tool for use a wellbore having a wellbore fluid flowing therein, said settable wellbore tool selectively operable to radially expand from a radially reduced dimension, for lowering within a wellbore surface of said wellbore, to a rapidly enlarged dimension in which said settable wellbore tool is urged into a gripping engagement with said wellbore surface, said settable wellbore tool comprising:

an actuation fluid having an actuation fluid pressure provided by a fluid pressurization source which directs said actuation fluid to said settable wellbore tool;

an actuation fluid flowpath extending to said settable wellbore tool, and providing a fluid flow path for said actuation fluid to flow into said settable wellbore tool;

a fishing neck assembly having a fishing neck profile disposed at an upper end of said settable wellbore tool and about said actuation fluid flowpath;

a poppet valve assembly disposed about said actuation fluid flowpath for directing said actuation fluid within said settable wellbore tool, and selectively preventing at least a portion of said actuation fluid from flow towards said fluid pressurization source to maintain said actuation fluid within said settable wellbore tool;

a fluid actuated wellbore tool disposed about a portion of said actuation fluid flowpath for receipt of said actuation fluid, said fluid actuated wellbore tool including:

a mandrel disposed concentrically within said fluid actuated wellbore tool, having said bypass fluid flowpath therethrough, and defining a portion of said actuation fluid flowpath;

an inflation chamber concentrically disposed about said mandrel for receiving said actuation fluid directed from said fluid pressurization source, and wherein said actuation fluid directed into said inflation chamber urges an expansion of said inflation chamber from a deflated running position to an inflated setting position;

an annular inflatable wall concentrically disposed about said inflation chamber, said annular inflatable wall including:

an elastomeric sleeve concentrically disposed around said mandrel and said inflation chamber;

a plurality of flexible overlapping slats disposed around said mandrel and said inflation chamber, and concentrically disposed about said elastomeric sleeve for reenforcement of said elastomeric sleeve;

wherein said expansion of said inflation chamber from a deflated running position to an inflated setting position urges a radial expansion of said annular inflatable wall from an unexpanded running position, which allows passage of said settable wellbore tool within said wellbore surface, and into a radially expanded position in said gripping engagement with said wellbore surface;

wherein said radial expansion of said annular inflatable wall restricts flow of said wellbore fluid and creates a pressure differential across said fluid actuated wellbore tool which urges said settable wellbore tool to move longitudinally within said wellbore;

a bypass fluid flow path extending through said settable wellbore tool for providing a fluid flowpath for said wellbore fluid to flow therethrough in response to said pressure differential across said fluid actuated wellbore tool to prevent said pressure differential from urging said settable wellbore tool to move longitudinally within said wellbore prior to said annular inflatable wall being in said gripping engagement with said wellbore surface; and a valving assembly disposed below said fishing neck and about said bypass fluid flow path, said valving assembly further including:

a movable valve stem concentrically disposed within said valving assembly and having at least one ratchet tooth, said movable valve stem selectively movable into an extended position once said annular inflatable wall is in said gripping engagement with said wellbore surface;

a plurality of longitudinally extending collet fingers which engage said at least one ratchet tooth to prevent movement of said movable valve stem in a first longitudinal direction of said settable wellbore tool, and which further flex to allow movement of said movable valve stem in a second longitudinal direction of said settable wellbore tool into said extended position;

a plug section concentrically disposed within said valving assembly and at least adjacent to said bypass fluid flowpath, said plug section secured to said movable valve stem wherein a selective movement of said movable valve stem in said second longitudinal direction into said extended position urges said plug section into a sealing engagement within said bypass fluid flowpath;

at least one shearable element disposed adjacent to said movable valve stem to, at least in part, maintain said movable valve stem against movement in a said second longitudinal direction until a preselected fluid pressure differential is applied to said actuation fluid within said inflation chamber to sever said shearable element for allowing said movable valve stem to move in said second longitudinal direction; and a guide assembly disposed on a lower end of said settable wellbore tool and having a flow path therethrough defining a portion of said bypass fluid flowpath.

19. The settable wellbore tool of claim 18, wherein said fluid pressurization source is a wireline pump which urges said actuation fluid within said inflation chamber to said preselected fluid pressure differential having an actuation fluid pressure in excess of five hundred pounds per square inch greater than a wellbore pressure of said wellbore fluid about said settable wellbore tool;

wherein said actuation fluid within said inflation chamber at said actuation fluid pressure urges said inflation chamber into said setting position and said annular inflatable wall into said gripping engagement with said wellbore surface; and wherein said actuation fluid within said inflation chamber at said actuation fluid pressure urges said selective movement of said movable valve stem into said extended position to urge said plug section into said sealing engagement within said bypass fluid flow path to prevent fluid flow therethrough.

20. A settable wellbore tool for use in through tubing operations in a wellbore having a wellbore fluid flowing therein, said settable wellbore tool selectively operable to radially expand from a radially reduced dimension, for lowering through a tubing string concentrically disposed within a wellbore surface, to a radially enlarged dimension in which said settable wellbore tool is urged into a gripping engagement with said wellbore surface after said settable wellbore tool is lowered through said tubing string, said settable wellbore tool comprising:

an actuation fluid having an actuation fluid pressure provided by a fluid pressurization source which directs said actuation fluid to said settable wellbore tool;

an actuation fluid flowpath extending to said settable wellbore tool, and providing a fluid flow path for said actuation fluid to flow into said settable wellbore tool;

a fishing neck assembly having a fishing neck profile disposed at an upper end of said settable wellbore tool and about said actuation fluid flowpath;

a poppet valve assembly disposed about said actuation fluid flowpath for directing said actuation fluid within said settable wellbore tool, and selectively preventing at least a portion of said actuation fluid from flow towards said fluid pressurization source to maintain said actuation fluid within said settable wellbore tool;

a fluid actuated wellbore tool disposed about a portion of said actuation fluid flowpath for receipt of said actuation fluid, said fluid actuated wellbore tool including:

a mandrel disposed concentrically within said fluid actuated wellbore tool, having said bypass fluid flowpath therethrough, and defining a portion of said actuation fluid flowpath;

an inflation chamber concentrically disposed about said mandrel for receiving said actuation fluid directed from said fluid pressurization source, and wherein said actuation fluid directed into said inflation chamber urges an expansion of said inflation chamber from a deflated running position to an inflated setting position;

an annular inflatable wall concentrically disposed about said inflation chamber, said annular inflatable wall including:

an elastomeric sleeve concentrically disposed around said mandrel and said inflation chamber;

a plurality of flexible overlapping slats disposed around said mandrel and said inflation chamber, and concentrically disposed about said elastomeric sleeve for reenforcement of said elastomeric sleeve;

wherein said expansion of said inflation chamber from a deflated running position to an inflated setting position urges a radial expansion of said annular inflatable wall from an unexpanded running position, which allows passage of said settable wellbore tool through said tubing, and into a radially expanded position in said gripping engagement with said wellbore surface;

wherein said radial expansion of said annular inflatable wall restricts flow of said wellbore fluid and creates a pressure differential across said fluid actuated wellbore tool which urges said settable wellbore tool to move longitudinally within said wellbore;

a bypass fluid flow path extending through said settable wellbore tool for providing a fluid flowpath for said wellbore fluid to flow therethrough in response to said pressure differential across said fluid actuated wellbore tool to prevent said pressure differential from urging said settable wellbore tool to move longitudinally within said wellbore prior to said annular inflatable wall being in said gripping engagement with said wellbore surface; and a valving assembly disposed below said fishing neck and about said bypass fluid flow path, said valving assembly further including:

a movable valve stem concentrically disposed within said valving assembly and having at least one ratchet tooth, said movable valve stem selectively movable into an extended position once said annular inflatable wall is in gripping engagement with said wellbore surface;

a plurality of longitudinally extending collet fingers which engage said at least one ratchet tooth to prevent movement of said movable valve stem in a first longitudinal direction of said settable wellbore tool, and which further flex to allow movement of said movable valve stem in a second longitudinal direction of said settable wellbore tool into said extended position;

a plug section concentrically disposed within said valving assembly and at least adjacent to said bypass fluid flowpath, said plug section secured to said movable valve stem wherein a selective movement of said movable valve stem in said second longitudinal direction into said extended position urges said plug section into a sealing engagement within said bypass fluid flowpath;

at least one shearable element disposed adjacent to said movable valve stem to, at least in part, maintain said movable valve stem against movement in a said second longitudinal direction until a preselected fluid pressure differential is applied to said actuation fluid within said inflation chamber to sever said shearable element for allowing said movable valve stem to move in said second longitudinal direction; and a guide assembly disposed on a lower end of said settable wellbore tool and having a flow path therethrough defining a portion of said bypass fluid flowpath.

21. The settable wellbore tool of claim 20, wherein said fluid pressurization source is a wireline pump which urges said actuation fluid within said inflation chamber to said preselected fluid pressure differential having an actuation fluid pressure in excess of five hundred pounds per square inch greater than a wellbore pressure of said wellbore fluid about said settable wellbore tool;

wherein said actuation fluid within said inflation chamber at said actuation fluid pressure urges said inflation chamber into said setting position and said annular inflatable wall into said gripping engagement with said wellbore surface; and wherein said actuation fluid within said inflation chamber at said actuation fluid pressure urges said moveable valve stem to selectively move into said extended position to urge said plug section to sealingly engage within said bypass fluid flow path to prevent said wellbore fluid from flowing therethrough.

* * * * *